US009656849B2

(12) United States Patent
Hawken

(10) Patent No.: US 9,656,849 B2
(45) Date of Patent: May 23, 2017

(54) MODULAR VALVE ARRAY HAVING A SINGLE DISPENSE POINT

(71) Applicant: Cornelius, Inc., St. Paul, MN (US)

(72) Inventor: Phil C. Hawken, Darien, IL (US)

(73) Assignee: Cornelus, Inc., St. Paul, MN (US)

( * ) Notice: Subject to any disclaimer, the term of this patent is extended or adjusted under 35 U.S.C. 154(b) by 0 days.

(21) Appl. No.: 14/253,614

(22) Filed: Apr. 15, 2014

(65) Prior Publication Data

US 2014/0361041 A1 Dec. 11, 2014

Related U.S. Application Data

(60) Provisional application No. 61/832,599, filed on Jun. 7, 2013.

(51) Int. Cl.

| | |
|---|---|
| ***B67D 1/00*** | (2006.01) |
| *B67D 1/08* | (2006.01) |
| *B67D 1/12* | (2006.01) |

(52) U.S. Cl.

CPC ..... *B67D 1/0085* (2013.01); *B67D 1/0021* (2013.01); *B67D 1/0024* (2013.01); *B67D 1/0044* (2013.01); *B67D 1/0888* (2013.01); *B67D 1/1202* (2013.01); *B67D 2001/0094* (2013.01); *B67D 2210/0006* (2013.01)

(58) Field of Classification Search

CPC .... B67D 1/0021; B67D 1/0044; B67D 1/005; B67D 1/0041; B67D 1/0043; B67D 1/0085; B67D 1/0888; B67D 2210/0006; B67D 2001/0088; B67D 2001/0094; B67D /

USPC ..... 222/129.1, 132, 135, 145.2, 460–462, 222/478–489, 566–571, 330, 145.1, 222/144.5; 137/884

See application file for complete search history.

(56) References Cited

U.S. PATENT DOCUMENTS

| | | | | |
|---|---|---|---|---|
| 3,009,653 | A * | 11/1961 | Hedeman | B67D 1/0085 222/129.4 |
| 3,628,566 | A * | 12/1971 | Carse | B67D 1/12 137/524 |
| 3,698,432 | A * | 10/1972 | Kutz | F15B 13/0814 137/271 |
| 3,853,244 | A * | 12/1974 | Neumann | 222/129.1 |
| 4,708,155 | A * | 11/1987 | Austin et al. | 137/1 |
| 4,821,925 | A * | 4/1989 | Wiley | B67D 1/0035 137/606 |

(Continued)

FOREIGN PATENT DOCUMENTS

| | | |
|---|---|---|
| DE | 3812450 | 11/1988 |

OTHER PUBLICATIONS

International Search Report and Written Opinion, PCT/US2014/041116, date of mailing Oct. 27, 2014.

(Continued)

*Primary Examiner* — Paul R Durand
*Assistant Examiner* — Andrew P Bainbridge
(74) *Attorney, Agent, or Firm* — Andrus Intellectual Property Law, LLP

(57) ABSTRACT

The invention relates to a valve dispensing system that can be used in a beverage dispenser. In particular, the valve dispensing system has individual valve module components that control the flow of a beverage or beverage component, and a plurality of valve module components may be combined to form a system capable of dispensing a plurality of beverages and/or beverage components.

15 Claims, 5 Drawing Sheets

(56) References Cited

U.S. PATENT DOCUMENTS

| | | | | |
|---|---|---|---|---|
| 4,932,564 | A * | 6/1990 | Austin | B67D 1/0085 222/129.1 |
| 5,033,651 | A * | 7/1991 | Whigham | B67D 1/0052 222/1 |
| 5,285,815 | A * | 2/1994 | Henry | B67D 1/0044 137/595 |
| 5,685,458 | A | 11/1997 | Durham et al. | |
| 6,202,894 | B1 * | 3/2001 | Struminski | B67D 1/0037 222/129.3 |
| 6,684,901 | B1 * | 2/2004 | Cahill et al. | 137/315.03 |
| 8,479,954 | B2 * | 7/2013 | Schroeder | B67D 1/0084 137/884 |
| 8,985,153 | B2 * | 3/2015 | Didier | F15B 13/0817 137/271 |
| 9,010,579 | B2 * | 4/2015 | Baker | B67D 1/0086 222/129.1 |
| 9,085,451 | B2 * | 7/2015 | Santy | B67D 1/0036 |
| 9,260,283 | B2 * | 2/2016 | Minica | B67D 1/0085 |
| 9,271,604 | B2 * | 3/2016 | Hecht | A47J 31/52 |
| 2004/0245288 | A1 | 12/2004 | Tobler | |
| 2005/0230421 | A1 * | 10/2005 | Morrow, Sr. | B67D 1/0054 222/132 |
| 2005/0269360 | A1 * | 12/2005 | Piatnik et al. | 222/129 |
| 2006/0071015 | A1 | 4/2006 | Jablonski et al. | |
| 2009/0173639 | A1 * | 7/2009 | Ferrari et al. | 205/743 |
| 2009/0277516 | A1 * | 11/2009 | Winkler et al. | 137/486 |
| 2011/0290336 | A1 * | 12/2011 | Campbell et al. | 137/15.05 |
| 2012/0055954 | A1 | 3/2012 | Hecht | |
| 2013/0206793 | A1 * | 8/2013 | Minica | B67D 1/0085 222/129.1 |
| 2014/0361041 | A1 * | 12/2014 | Hawken | B67D 1/0085 222/129.1 |
| 2016/0176696 | A1 * | 6/2016 | Hecht | B67D 1/0888 222/144.5 |

OTHER PUBLICATIONS

International Preliminary Report on Patentability, PCT/US2014/041116, date of mailing Dec. 17, 2015.

EP Extended Search Report, EP Patent Application No. 14 807 333.1, date of mailing Feb. 21, 2017.

* cited by examiner

MODULAR VALVE ARRAY HAVING A SINGLE DISPENSE POINT

This Application claims the benefit of the filing date under 35 U.S.C. §119(e) of U.S. Provisional Application No. 61/832,599, filed on Jun. 7, 2013, which is hereby incorporated by reference in its entirety.

BACKGROUND OF THE INVENTION

Field of the Invention

The present invention relates generally to the field of beverage dispensers, and more particularly to a modular valve assembly in which an array of valve modules are connected to a manifold for dispensing multiple different beverages through a single nozzle dispense point.

SUMMARY OF THE INVENTION

The present invention relates to a valve assembly for dispensing multiple beverages through a single nozzle dispense point. One aspect of the invention recognizes the need for a modular valve assembly that can easily be expanded to allow more types of beverages to be dispensed. A valve module has multiple fluid pathways and a flow control and shut-off component for controlling the flow of fluid through each pathway. A manifold is configured to receive at least one valve module, but may also be configured to receive multiple valve modules. Valve modules can easily be added to the manifold to expand the dispensing capacity of the valve assembly. The manifold also contains pathways for directing the fluid to a diffuser, which releases the fluid into a single nozzle dispense point.

DETAILED DESCRIPTION OF THE INVENTION

Figure 1:
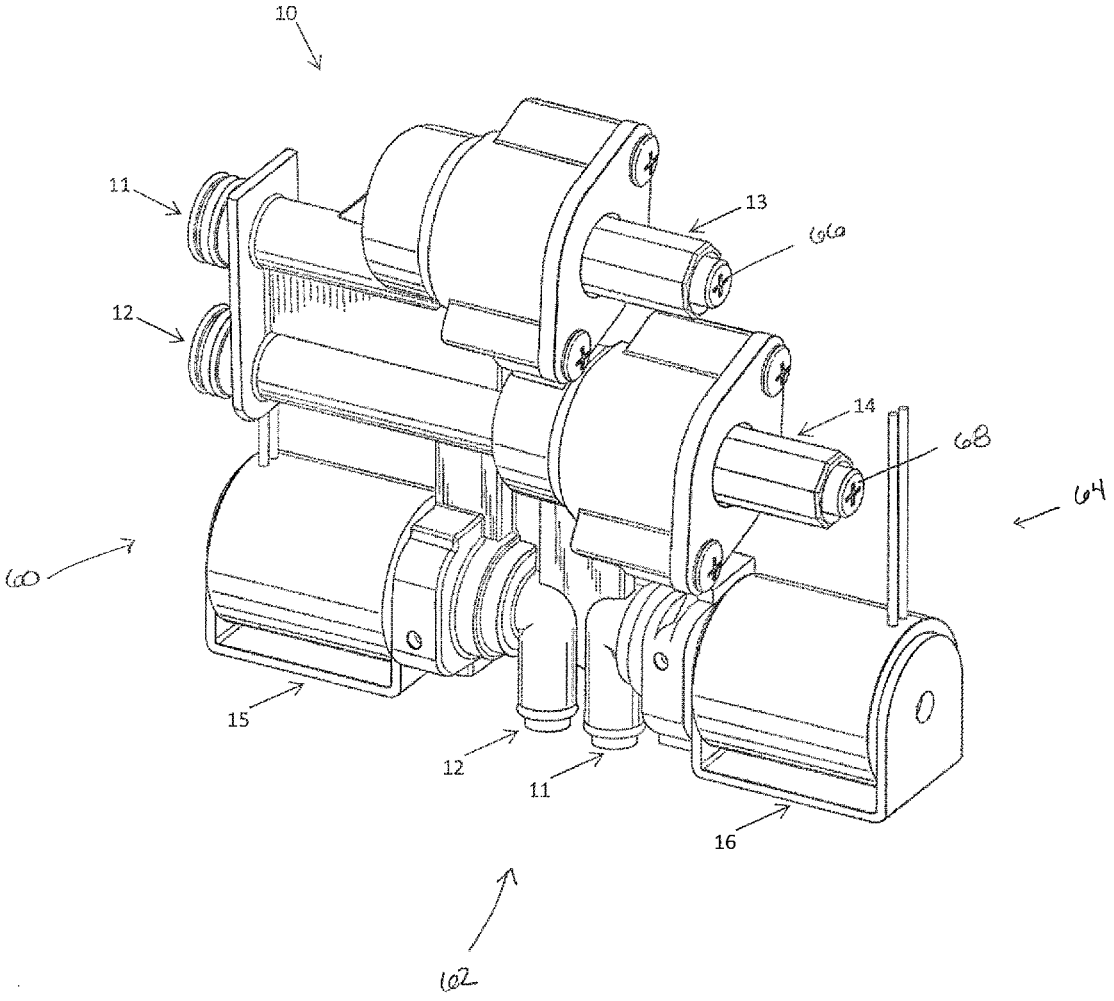
FIG. 1 is a side perspective view of a valve module having two fluid pathways.

Referring now to the drawings, FIGS. 1-5 show an embodiment of the valve assembly. The valve assembly 50, as in FIG. 5, uses one or more valve modules 10, as seen for example in FIG. 1, to create an expandable array of valves capable of dispensing different beverages. Valve module 10 contains fluid pathways 11, 12, that may be interfaced to a manifold 20. When a valve module 10 is connected to the manifold 20, the fluid pathway(s) 11, 12 of the valve module 10 interface with a corresponding pathway in the manifold 21, 22. The manifold 20 and manifold pathways 21 and 22 are show in greater detail in FIG. 2. In this way, a fluid may travel through a fluid pathway 11, 12 in the valve module 10 and into the corresponding pathway of the manifold 21, 22, which routes the fluid to a common dispense point 23. At the common dispense point 23, a diffuser 31 (as seen for example in FIG. 4) diffuses the fluid into a nozzle 32, where the fluid may mix with other fluids to create a beverage. Flow control 13, 14 and shut-off components 15, 16 in the valve module control the amount of fluid that flows through the pathways. Although valve module 10 in FIG. 1 is shown having two sets of fluid pathways 11, 12, it is understood that each valve module 10 may have any number of pathways.

Referring specifically to FIG. 1, the valve module 10 is shown as having two separate fluid pathways 11, 12. The fluid pathways 11, 12 are not in communication with each other. Each fluid pathway 11, 12 is controlled by a shut-off component 15, 16 and a flow control component 13, 14. Together, the shut-off component 15, 16 and the flow control component 13, 14 control the rate (or completely stop the flow) of a fluid flowing through the fluid pathways 11, 12. Although the shut-off component 15, 16 and the flow control components 11, 12 are shown separately in the embodiment of FIG. 1, it is also possible for a single component to control both the flow and the shut-off of a pathway.

In one embodiment, the shut-off component 15, 16 may be a solenoid designed to be ¼ turn twist on, which requires no tools to remove, install, or service. The solenoid may use a 24v DC direct pull and plunger assembly, but alternatively a "hit and hold" solenoid using electronic controls could also be used. For the flow-control component, a differential pressure ceramic flow control may be used. In an alternate embodiment, the flow-control component may include stepper motor rotary controls that function on flow feedback.

Figure 5:
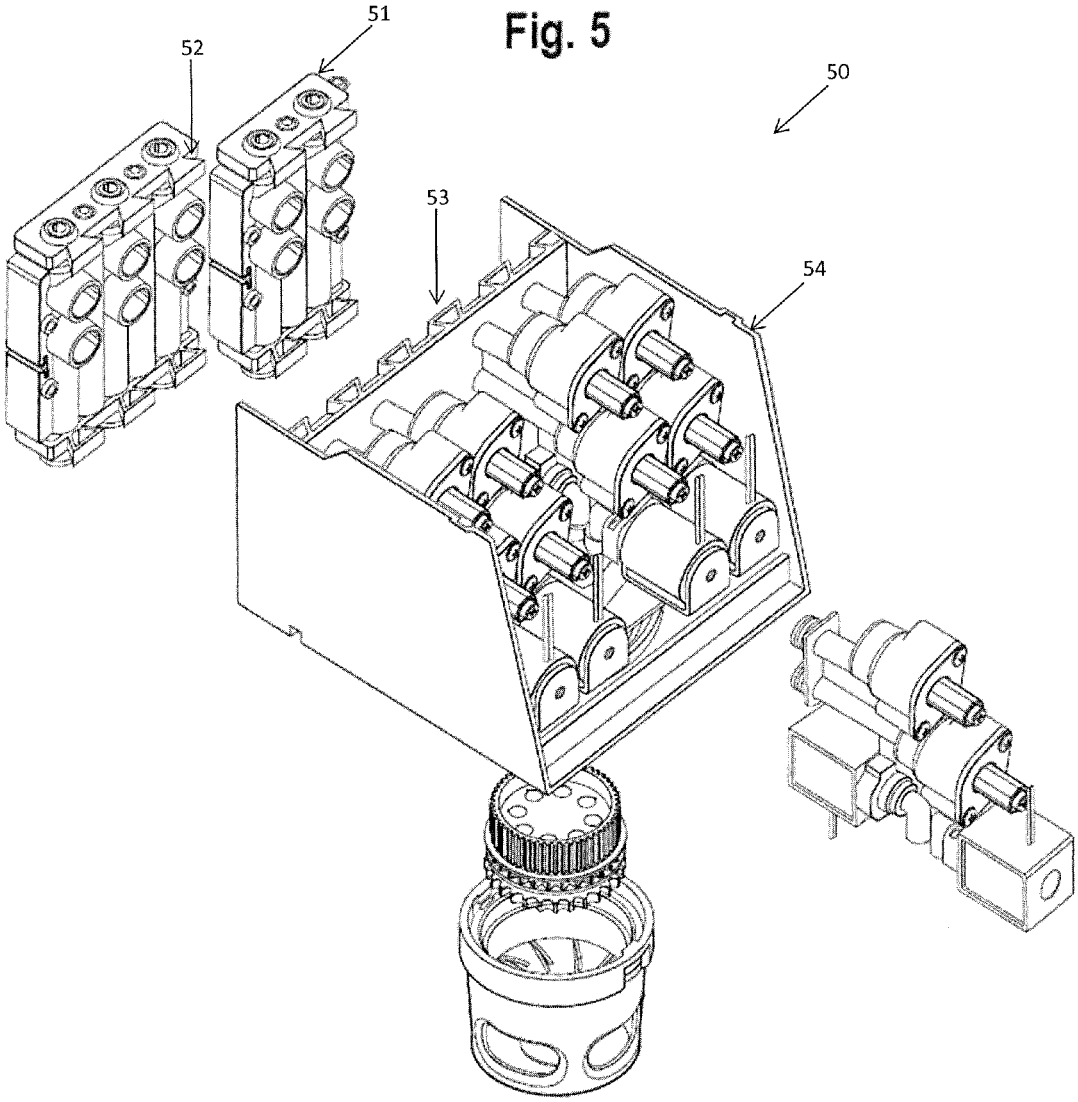
FIG. 5 shows an array of valve modules positioned within a housing.

The fluid pathways 11, 12 are configured to interface with a manifold 20 (see FIG. 2) on one end, and with a backblock 51 (see FIG. 5) on the other end. The backblock 51 provides fluid which may flow through the fluid pathways 11, 12 when the shut-off component 15, 16 and flow control component 13, 14 are in the open position. The backblock 51 may contain an interface to a fluid source. The backblock 51 may further include a heat exchanger for controlling the temperature of a fluid. An example thereof is disclosed in Applicant's U.S. Pat. App. 61/831,517, which is hereby incorporated in its entirety. The backblock 51 may be fastened to the housing using mating "dove-tail" fasteners 52, 53 as see in FIG. 5. More specifically, FIG. 5 shows a dovetail 52 on the backblock, and a mating receptacle 53 on the housing. Using mating dove-tail features to connect the housing to the backblock provides the added benefit being easily detachable for cleaning.

The fluid flowing from the backblock 51 into the valve module(s) 10 may be a branded beverage, or the fluid may be a beverage component, such as a syrup, concentrate, water, or carbonated water. The embodiment of FIG. 1 shows a valve module 10 having two fluid pathways 11, 12. But, a valve module 10 may have any number of fluid pathways. An advantage of using two fluid pathways per valve module is the ability to closely match the number of valves required by adding or removing valve modules.

Optionally, one or more of the valve modules may be in electronic communication with a CPU. Via the electronic communication, the CPU may be able to control either the valve module's shut off component and/or its flow control, thereby allowing the CPU to effectively control the volume and/or rate at which each of the valve modules dispenses a beverage. The valve modules may be controlled by a CPU, which receives a beverage recipe and drink size through an input, such as a touch screen or a conventional button, and operates the relevant valve modules 10 to dispense the required amount of each fluid. In other words, each valve module 10 contains a component of a beverage, and the CPU may operate the valve module(s) 10 to dispense the correct amount of each beverage component required to construct a beverage. The CPU may be in communication with a computer readable memory that uses non-transitory memory to store data representative of a beverage recipe. Thus, the CPU knows the correct amount of each beverage component that must be dispensed to construct a beverage. The CPU controls the opening and closing of the flow-control components 13, 14 of each valve module 10. Thus, the CPU may open any desired combination of valves for a predetermined time period to dispense the required quantity of each fluid.

Figure 2:
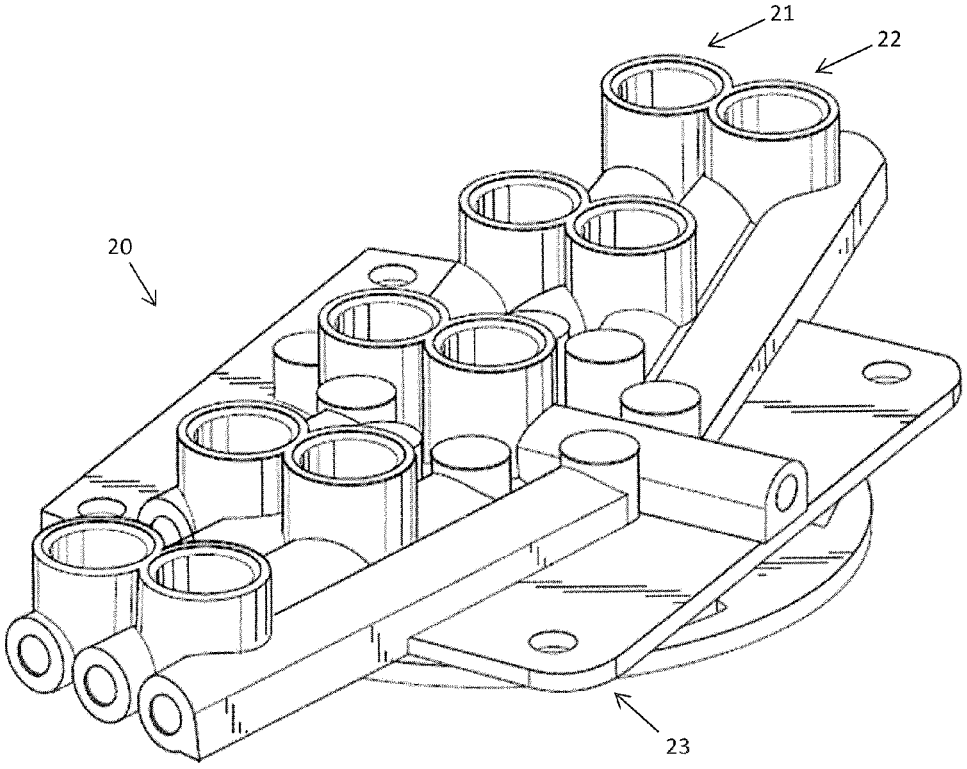
FIG. 2 is a top perspective view of a manifold.
Figure 3:
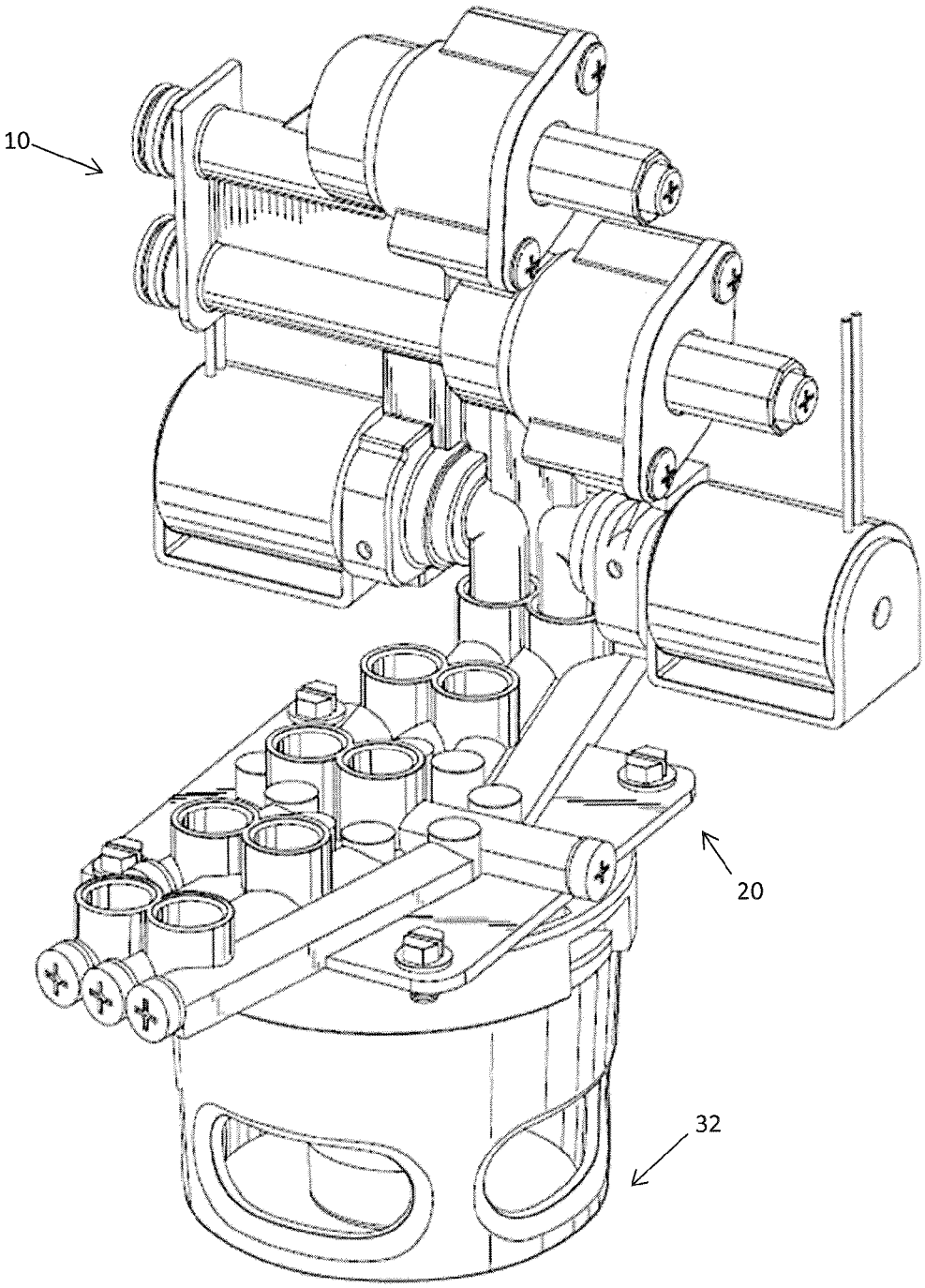
FIG. 3 is a side perspective of a valve module, manifold, and nozzle connected to each other.

FIG. 2 shows a manifold 20 which interfaces with the valve module 10. In FIG. 3, a manifold 20 and a valve module 10 are shown in the interfaced configuration. The manifold 20 used in this embodiment has five sets of two fluid pathways. Each set of these manifold pathways interfaces with the valve module fluid pathways when a valve module 10 is connected to the manifold. Thus, the manifold of FIG. 2 is capable of interfacing with five valve modules, where each valve module has two fluid pathways. It is understood that the manifold may be configured to receive any number of valve modules. Likewise, the housing 54 shown in FIG. 5 is configured to hold five valve modules, but may also be expanded according to a user's needs.

The manifold pathways 21, 22 direct fluid to a common dispense point 23. In the embodiment of FIG. 2, the common dispense point 23 is positioned near the center of the manifold, but alternate configurations are also possible. Moreover, it is preferable, but not necessary, that each manifold pathway 21, 22 have a slight downward slope from valve module interface to the common dispense point. A downward-sloping manifold pathway takes advantage of gravity to help move fluid to the common dispense point.

The manifold pathways 21, 22 of FIG. 2 are not in fluid communication with each other. It is envisioned that the fluid pathways 11, 12 of the valve module 10, and by extension the manifold pathways 21, 22, can carry different flavored beverages or beverage components. Separating the manifold pathways 21, 22 ensures that cross-contamination does not occur. Although there may be instances in which it is desirable to mix multiple beverages or beverages components (i.e. mixing a cherry concentrate with a cola beverage, or mixing a cola concentrate with carbonated water), the embodiment of FIG. 2 contemplates that such mixing should preferably occur in the nozzle.

In alternative embodiments, a subset of the manifold pathways 21, 22 may be in fluid communication with each other. For example, it may be desirable to create a common manifold pathway that mixes uncarbonated water and carbonated water to create a mid-carbonated water.

Figure 4:
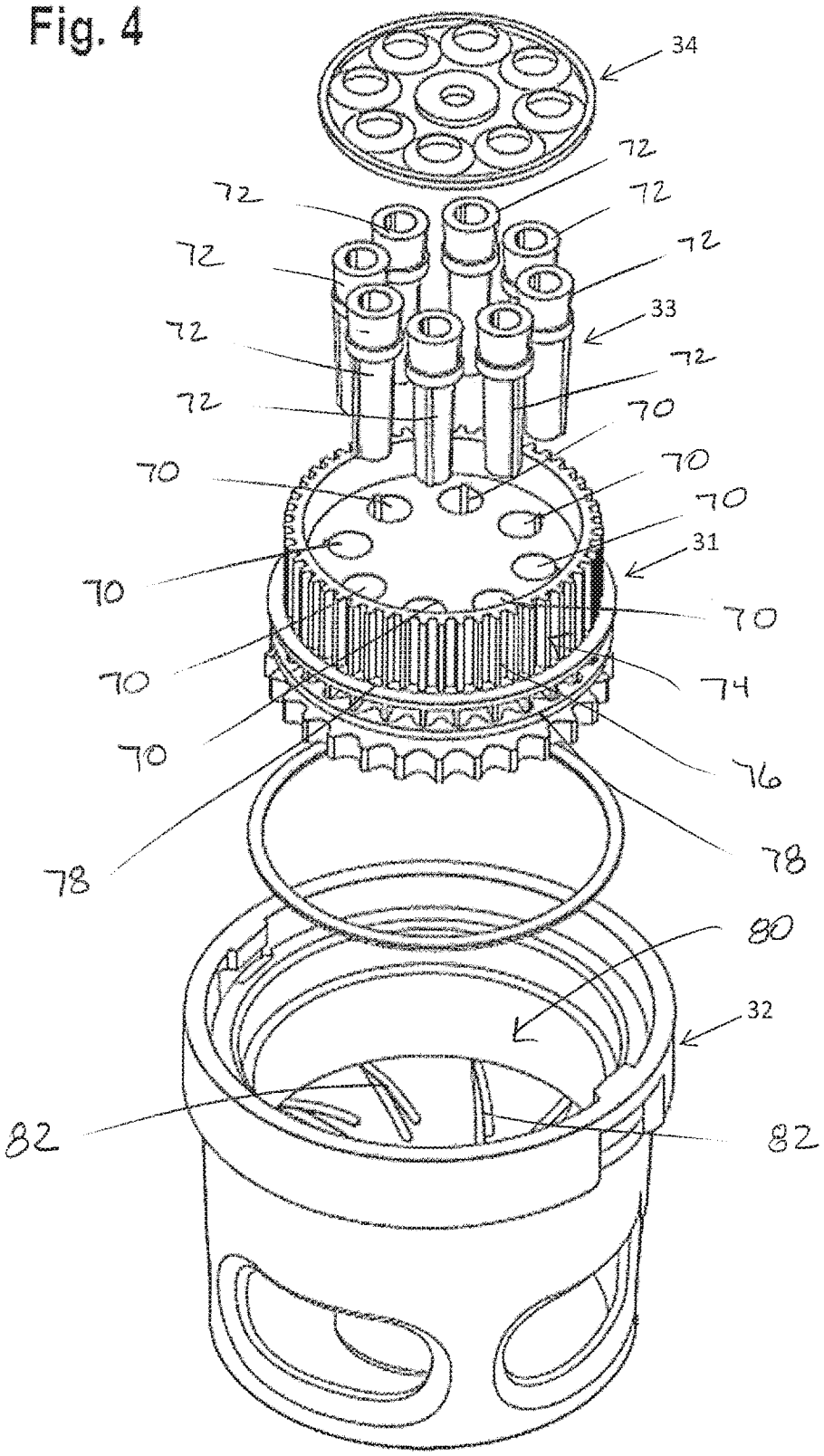
FIG. 4 shows a seal, syrup tips, diffuser and nozzle.

At the common dispense point 23, the manifold pathways 21, 22 open into a diffuser 31. The diffuser 31 is shown in FIG. 4. The diffuser 31 is designed to cause fluids to disperse into the nozzle 32. The various ridges and edges shown in the diffuser 31 of FIG. 4 have the effect of causing fluid to disperse evenly in the nozzle. The diffuser 31 provides the advantage of causing an even distribution of the fluid into the nozzle, which is beneficial because it enhances the mixing of multiple fluids. For example, where a cola and a cherry flavor are mixed in the nozzle 32, the diffuser 31 enhances the mixing of the fluids. Similarly, the diffuser 31 enhances the mixing of beverage syrup or concentrate with water or carbonated water. In the embodiment of FIG. 3, the diffuser 31 is designed to flow up to 4 ounces of water per second.

Moreover, syrup tips 33 (shown in FIG. 4) may be used to guide fluid from the manifold pathways 21, 22 into the diffuser 31. The use of syrup tips 33 provides the added benefit of reducing backsplash, and thus reducing the possibility of cross-contamination. Similarly, a seal 34 may be used to reduce potential leakage. In one embodiment, the seal 34 is a face-sealing silicon seal, which is easier to clean than typical 0-ring and bore type assemblies.

FIG. 3 shows a valve module 10 and a nozzle 32 mounted to the manifold 20. In operation, the valve module 10 and manifold 32 may be placed in a housing (not shown). Additional valve modules may be attached to the manifold in order to expand the dispense capability of the valve assembly.

It will thus be seen that the present disclosure teaches a valve assembly 50 for dispensing multiple beverages via a common nozzle 32 dispense point. The valve assembly 50 includes a plurality of valve modules 10, each valve module 10 having a plurality of separate fluid pathways 11, 12. A plurality of flow control components 13, 14 are configured to control flow of fluid in the separate fluid pathways 11, 12. A backblock 51, 52 couples the valve modules 10 to a fluid source for providing a flow of fluid to the separate fluid pathways 11, 12. A dispenser nozzle 32 forms the common nozzle 32 dispense point for the valve modules 10. A diffuser 31 receives the flow of fluid from the valve modules 10 and diffuses the flow of fluid into the dispenser nozzle 32.

Each of the valve modules 10 has a back side 60 that interfaces with the backblock 51, 52 and a bottom side 62 that interfaces with the diffuser 31. Each of the valve modules 10 also has a front side 64 that is opposite the back side 60. As show in FIG. 1, the bottom side 62 is perpendicular to the back side 60 and perpendicular to the front side 64. Each of the flow control components 13, 14 has a flow control device 66, 68 for controlling flow of fluid therethrough. Each flow control device 66, 68 faces the front side 64 so that the flow control device 66, 68 is easily accessed without removing the flow control component 10 from the valve assembly 50.

As further shown in FIG. 1, each separate fluid pathway 11, 12 extends horizontally from the back side 60 towards the front side 64 and then vertically downwardly to the bottom side 62. The separate fluid pathways 11, 12 extend parallel to each other from the back side 60 towards the front side 64 and then vertically downwardly to the bottom side 62. As shown in FIG. 1, the flow control components 13, 14 are vertically aligned on top of each other and are horizontally offset from each other so that the flow control devices 66, 68 are offset from each other. In the illustrated example, the flow control devices 66, 68 include a screw having a screwhead that faces the front side 64.

As also shown in FIG. 1, the shut off valves 15, 16 are located at the bottom side 62 and on opposite sides of the separate fluid pathways 11, 12.

Referring to FIG. 4, the diffuser 31 has a plurality of apertures 70 there through and a plurality of syrup tips 72 that are received in the plurality of apertures 70. The seal 34 forms a seal on the diffuser 31 and with the plurality of syrup tips 72.

As shown in FIG. 4, the diffuser 31 has a radially outer perimeteral surface 74 having axially extending ridges 76 that are configured to evenly distribute water to the dispenser nozzle 32. The diffuser 31 also has circumferentially extending channels 78 located below the ridges 76 and further configured to evenly distribute water to the dispenser nozzle 32.

As shown in FIG. 4, the dispenser nozzle 32 has an inner cavity 80 with a plurality of helical ribs 82 for inducing helical flow through the dispenser nozzle 32.

What is claimed is:

1. A valve assembly for dispensing multiple beverages via a common nozzle dispense point, the valve assembly comprising:

a plurality of valve modules, wherein each valve module in the plurality of valve modules has a plurality of separate fluid pathways;

a plurality of flow control components that control flow of fluid in the plurality of separate fluid pathways, wherein a flow control component from the plurality of flow control components is provided for each separate fluid pathway in the plurality of separate fluid pathways;

a backblock that couples the plurality of valve modules to a fluid source for providing a flow of fluid to the plurality of separate fluid pathways;

a dispenser nozzle that forms the common nozzle dispense point for the plurality of valve modules; and a diffuser that receives the flow of fluid from the plurality of valve modules and diffuses the flow of fluid into the dispenser nozzle; wherein each of the plurality of valve modules have a back side that interfaces with the backblock, each of the plurality of valve modules have a bottom side that interfaces with the diffuser, wherein the bottom side is perpendicular to the back side, each of the plurality of valve modules have a front side that is opposite the back side and perpendicular to the bottom side, and each of the flow control components has a flow control device for controlling flow of fluid there through, each flow control device facing the front side so that the flow control device can be accessed without removing the flow control component from the valve assembly;

wherein the each separate fluid pathway extends horizontally from the back side towards the front side and then vertically downwardly to the bottom side;

wherein the plurality of separate fluid pathways extend parallel to each other from the back side towards the front side and wherein the plurality of separate fluid pathways extend parallel to each other towards the bottom side;

wherein the plurality of flow control components in each valve module are vertically aligned on top of each other;

wherein the plurality of flow control components in each valve module are horizontally offset from each other from the back side towards the front side;

a plurality of shut off components that are configured to shut off flow of fluid in the plurality of separate fluid pathways, wherein one shut off component from the plurality of shut off components is provided for each separate fluid pathway in the plurality of separate fluid pathways;

wherein the plurality of shut off components comprises first and second shut off components that are located at the bottom side and face each other on opposite sides of the plurality of separate fluid pathways.

2. The valve assembly according to claim 1, wherein the flow control device comprises a screw having a screw head that faces the front side.

3. The valve assembly according to claim 1, wherein the bottom side is configured to be manually coupled to and uncoupled from the diffuser.

4. The valve assembly according to claim 1, wherein the first and second shut off components each comprises a solenoid.

5. The valve assembly according to claim 1, wherein the diffuser comprises a plurality of apertures there through and further comprising a plurality of syrup tips that are received in the plurality of apertures, each syrup tip configured to separately guide the flow of fluid to the dispenser nozzle.

6. The valve assembly according to claim 5, further comprising a seal that forms a seal on the diffuser and with the plurality of syrup tips.

7. The valve assembly according to claim 6, wherein the seal forms a face seal with the diffuser and wherein the plurality of syrup tips extend through the seal and are sealed there with.

8. The valve assembly according to claim 5, wherein the diffuser comprises a radially outer perimeteral surface that comprises a plurality of axially extending ridges configured to evenly distributing water to the dispenser nozzle.

9. The valve assembly according to claim 8, wherein the diffuser further comprises a plurality of circumferentially extending channels located below the plurality of axially extending ridges and configured to evenly distribute water to the dispenser nozzle.

10. The valve assembly according to claim 8, wherein the dispenser nozzle comprises an inner cavity having a plurality of helical ribs for inducing helical flow through the dispenser nozzle.

11. The valve assembly according to claim 1, further comprising a manifold configured to releasably couple with the plurality of valve modules such that the plurality of valve modules form an expandable and contractible array of valve modules.

12. The valve assembly according to claim 11, wherein the manifold comprises a downwardly sloping pathway extending from the plurality of valve modules to the common nozzle dispense point.

13. The valve assembly according to claim 12, further comprising a housing that houses the manifold and the plurality of valve modules, wherein the flow control device of each of the plurality of valve modules is accessible on the front side.

14. A valve module for dispensing multiple beverages, the valve module comprising:

a plurality of separate fluid pathways;

a plurality of flow control components that control flow of fluid in the plurality of separate fluid pathways, wherein a flow control component from the plurality of flow control components is provided for each separate fluid pathway in the plurality of separate fluid pathways;

a backblock that couples the plurality of valve modules to a fluid source for providing a flow of fluid to the plurality of separate fluid pathways;

wherein the valve module has a back side that interfaces with the backblock, a bottom side that interfaces with a diffuser, wherein the bottom side is perpendicular to the back side, and a front side that is opposite the back side and perpendicular to the bottom side, and wherein each of the flow control components has a flow control device for controlling flow of fluid there through, wherein each flow control device faces towards the front side so that the flow control device can be accessed;

wherein the plurality of separate fluid pathways each extend horizontally from the back side towards the front side and then vertically downwardly to the bottom side;

wherein the plurality of separate fluid pathways each extend parallel to each other from the back side towards the front side and wherein the plurality of separate fluid pathways each extend parallel to each other towards the bottom side;

wherein the plurality of flow control components in each valve module are vertically aligned on top of each other;

wherein the plurality of flow control components in each valve module are horizontally offset from each other from the back side to the front side so that the plurality of flow control devices in each valve module are horizontally offset from each other;

wherein the bottom side is configured to be manually coupled to and uncoupled from a diffuser; and a plurality of shut off components that are configured to shut off flow of fluid in the plurality of separate fluid pathways, wherein one shut off component from the plurality of shut off components is provided for each separate fluid pathway in the plurality of separate fluid pathways;

wherein the plurality of shut off components comprises first and second shut off components that are located in first and second separate fluid pathways in the plurality of fluid pathways, the first and second shut off components located at the bottom side and face each other on opposite sides of the plurality of fluid pathways.

15. A valve module for dispensing multiple beverages, the valve module comprising:

first and second fluid pathways that are separate from each other;

first and second flow control devices that are configured to control flow of fluid through the first and second fluid pathways, respectively; and first and second shut off components that are configured to shut off the flow of fluid in the first and second fluid pathways, respectively;

wherein the valve module has a back side that is configured to receive the flow of fluid, a bottom side that is transverse to the back side and configured to discharge the flow of fluid, and a front side that is opposite the back side;

wherein the first and second fluid pathways extend from the back side towards the front side and then downwardly to the bottom side;

wherein the first and second flow control device are accessible via the front side;

wherein the first and second flow control devices are vertically aligned and are horizontally offset with respect to each other; and wherein the first and second shut off components are located at the bottom side and face each other on opposite sides of the first and second fluid pathways.

* * * * *